US008375516B2

(12) United States Patent
Baines et al.

(10) Patent No.: US 8,375,516 B2
(45) Date of Patent: Feb. 19, 2013

(54) JOINERY

(75) Inventors: Ian Paul Baines, New Plymouth (NZ); David Kenning Solly, New Plymouth (NZ)

(73) Assignee: Open Building Solutions Limited, New Plymouth (NZ)

( * ) Notice: Subject to any disclaimer, the term of this patent is extended or adjusted under 35 U.S.C. 154(b) by 444 days.

(21) Appl. No.: 12/714,787

(22) Filed: Mar. 1, 2010

(65) Prior Publication Data

US 2010/0218430 A1 Sep. 2, 2010

(30) Foreign Application Priority Data

Mar. 2, 2009 (NZ) ..... 575249

(51) Int. Cl.
*E05D 15/00* (2006.01)
*E05D 13/00* (2006.01)

(52) U.S. Cl. ..... 16/91; 16/87.4 R; 16/95 R; 49/425; 49/411

(58) Field of Classification Search ..... 16/91, 87 R, 16/87.4 R, 90, 93 R, 94 R, 95 R, 96 R, 97, 16/100, 106, 107, 87 B; 49/425, 409, 410, 49/411; 160/199, 206
See application file for complete search history.

(56) References Cited

U.S. PATENT DOCUMENTS

| | | | | | |
|---|---|---|---|---|---|
| 149,729 | A | * | 4/1874 | Dotterer | 16/96 R |
| 215,993 | A | * | 5/1879 | Townsend | 16/100 |
| 791,915 | A | * | 6/1905 | Kade | 16/100 |
| 2,078,811 | A | * | 4/1937 | Rouse | 16/100 |
| 2,664,598 | A | * | 1/1954 | Greig | 16/100 |
| 2,668,317 | A | * | 2/1954 | Bon, III | 16/91 |
| 2,668,318 | A | * | 2/1954 | Bon, III | 16/100 |
| 3,237,238 | A | * | 3/1966 | Anderson | 16/100 |
| 3,255,807 | A | * | 6/1966 | Steele, Jr. | 16/100 |
| 3,583,101 | A | * | 6/1971 | Pudenz | 49/425 |
| 3,996,643 | A | * | 12/1976 | Steigerwald | 49/425 |
| 4,262,451 | A | * | 4/1981 | Dallaire | 49/425 |
| 5,606,903 | A | | 3/1997 | Drittel | |
| 5,791,089 | A | * | 8/1998 | Prevot et al. | 49/425 |
| 6,021,547 | A | * | 2/2000 | Stagoll | 49/425 |
| 6,662,934 | B1 | | 12/2003 | Iida | |
| 2001/0054258 | A1 | * | 12/2001 | Becken | 49/409 |

FOREIGN PATENT DOCUMENTS

| | | |
|---|---|---|
| NZ | 537940 | 10/2006 |
| NZ | 547111 | 7/2007 |
| NZ | 547110 | 11/2007 |

OTHER PUBLICATIONS

New Zealand Patent Office issued a a Patmark Search Report dated Jul. 29, 2008, Application No. 203965NZ.

* cited by examiner

*Primary Examiner* — Jeffrey O Brien
(74) *Attorney, Agent, or Firm* — Young & Thompson

(57) ABSTRACT

A movable carriage assembly for a door track or window track is adapted to support a door or window. The carriage assembly includes a lower carriage removably joined to an upper carriage, forming an elongate gap there between which is constructed and adapted to provide a sliding surface element for a track dust cover. When the carriage assembly moves along the track, the dust cover moves through the gap of the carriage assembly and over the sliding surface element whereby the dust cover is caused to disengage from the track and re-engage with track after the carriage assembly has passed. There is also disclosed a method of installing the carriage assembly in a window or door opening for a door or window.

11 Claims, 13 Drawing Sheets

JOINERY

The invention relates to a movable carriage assembly for doors or windows in buildings and to a method of installation. The invention is directed particularly but not solely towards a carriage and bottom track for a bi-fold or sliding door but can be used for any joinery that needs to be moved via a covered track.

BACKGROUND OF INVENTION

Traditionally doors such as bifold or sliding doors have carriages or trolleys on the top or bottom which rely on being supported and guided by a tracking system whereby some doors can be called 'top hung' or 'bottom hung' doors. The tracking system comprises an aluminum extrusion system having an open track. However with top hung doors the extrusion system has to be very strong to be able to support the weight of the door hanging there-from. In some cases the top hung extrusion or a building lintel, can sag thereby causing the door to not be able to move or open.

Bottom hung doors do not suffer this sagging problem but instead the track can clog up with dirt or dust to also cause the door or window to jam or not move or open as required. A clogged up track can look unsightly and be very difficult to prevent or even clean.

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

OBJECT OF THE INVENTION

It is an object of the invention to provide movable carriage assembly and method of installation that ameliorates some of the disadvantages and limitations of the known art or at least provide the public with a useful choice.

SUMMARY OF INVENTION

In a first aspect the invention resides in a movable carriage assembly for a door or window track having a dust cover engaged on a track whereby the movable carriage assembly is adapted to movably support a door or window, the assembly includes a lower carriage removably joined to an upper carriage, forming an elongate gap therein constructed and adapted to provide a sliding surface means for a track dust cover to slide therein when the carriage assembly moves along the track, the dust cover moves through the gap of the carriage assembly and over the sliding surface means whereby the dust cover is caused to disengage from the track and re-engage with the track after the carriage assembly has passed.

Preferably the elongate gap is formed in use having an upper sliding surface and a lower sliding surface whereby the carriage assembly includes a lower carriage removably joined to an upper carriage, forming the elongate gap therein wherein the gap is curved in shape extending from one end of the carriage assembly to the other.

Preferably, the lower carriage comprises a body with an upper body portion and a lower body portion, the upper body portion includes a frame and the lower body portion includes a convex shaped body whereby the frame is supported by the convex shaped body, and the convex shaped body includes, wheels to rollably move on the track and also includes the lower sliding surface for the dust cover to slide there against.

Preferably, the upper carriage includes a plate shaped member with an up stand member extending there from, the up stand member is adapted to support a door or window there from and the dust cover is an elongate flexible strip like member.

Preferably the track is an elongate member formed having a box-like cross section with an inner lower track surface and re-entrant upper portion with grooved edges adapted to allow the flexible dust cover to be fitted and supported therein and there along.

Preferably a substantial portion of the upper sliding surface is provided by the lower carriage whereby the frame includes end ramp-like surfaces spaced apart being downwardly facing. (see FIG. 8)

Alternatively the upper sliding surface is provided by the upper carriage whereby the plate member has ramp-like surfaces spaced underneath at each end to allow the dust cover to slide there against (see FIGS. 3 & 4).

Preferably, when in use the carriage moves along the track, the ramps and curvature must be shallow enough to allow the dust cover to gently move out and in of the groove edges of the re-entrant member of the track.

Preferably, the dust cover must be flexible enough to be moved out of edge alignment and yet be strong enough to allow someone to stand on it and not deform or break or dislodge from the track wherein the dust cover can be provided an undercut to better enable the strip to move in and out of alignment with the re-entrant edge of the track.

Preferably the track and carriage assembly form a sealed chamber to prevent dust or any contamination therein.

Preferably the carriage assembly includes a cleaning means in the form of a brush member attached to the carriage to wipe excess debris from the cover prior to the disengage/re-engaging action of the cover.

In a second aspect the invention resides a method of installing the carriage assembly in a window or door opening for a door or window which includes the following steps of:

- fitting or providing a track with a dust cover;
- cutting out a portion of the track for the carriage;
- dropping in the lower carriage of the carriage;
- installing other window/door framing for the opening;
- attaching the upper carriage to the lower carriage to slidably surround the dust cover;
- attaching the door or window support means to the upper carriage;
- attaching door or window to a door or window support means such that the door and carriage can slide along the track and dust cover thereby maintaining a dust and or moisture cover at all times.

BRIEF DESCRIPTION

The invention will now be described, by way of example only, by reference to the accompanying drawings:

FIG. 1 is an upper perspective view of the movable carriage and track assembly in accordance with a first preferred embodiment of the invention.

FIG. 2 is an upper perspective view of the movable carriage and track assembly without the door hinge and showing part of the inner working.

FIG. 3 is upper perspective view of a lower portion of the carriage without wheels FIG. 4 is a rear perspective view of the lower portion of the carriage of FIG. 3.

FIG. 5 is an upper perspective view of an upper portion of the carriage.

FIG. 6 is a rear perspective view of the upper portion of FIG. 5.

FIG. 7 is a perspective front view of a second preferred embodiment of the invention FIG. 8 is an exploded view of the carriage of FIG. 7.

FIG. 9 is a cross section end view of the carriage of FIG. 7 in use in a track.

FIG. 10 is a top plane view of the assembly of FIG. 9.

FIG. 11 is a left hand side view of the assembly.

FIG. 12 is a perspective cut out sliced view of the carriage and track of FIG. 9.

FIG. 13 is sliced side view of the carriage and track.

DESCRIPTION OF DRAWINGS

The following description will describe the invention in relation to preferred embodiments of the invention, namely a movable carriage and track assembly and method of installation. The invention is in no way limited to these preferred embodiments as they are purely to exemplify the invention only and that possible variations and modifications would be readily apparent without departing from the scope of the invention.

In the FIGS. 1-6 a movable carriage assembly and track is shown in use which includes a carriage assembly 2 and track 3. Carriage assembly 2 is operationally attachable to a door or window supporting member 4 via for example a hinge. Carriage assembly 2 is made up of a lower carriage 10 which is removably joined to an upper carriage 11 to form a gap there between sliding surface means. In use lower carriage 10 can be termed a carriage main body while the upper carriage 11 can be termed an intermediate linkage plate. As shown the lower carriage 10 and upper carriage 11 can be joined together using fixing means 59 which can be for example screws or bolts.

As shown in FIG. 2 the wheels 13 can be grooved or not, with the track 3 protruding in a complementary fashion to rollably inter fit there-with. The track 3 comprises a profiled extrusion which is also adapted to slidably capture the lower carriage 10 of the carriage assembly 2. Track 3 comprises an elongate body having channel shape with an outer surface 15 and an inner surface 16. The inner surface 16 forms a substantially enclosed space 17 having an upper re-entrant portion 18 and which such space has a lower inner wheel support surface 19. Track 3 can have any cross section that still enables it to function as a support for the carriage assembly and have a dust cover so in this example track 3 has an overall box like cross section.

As shown in FIGS. 3 and 4 lower carriage 10 has a sliding surface means whereby there is a lower body portion which includes a wheel holding portion 27 comprising a curved splayed elongate member or in use a convex shaped member having an upper surface 28 and lower facing surface 29. Upper surface 28 forms part of the sliding surface means for the carriage assembly. Wheel holding portion 27 is elongate in shape and has ends 35 and side edges 36. With the upper surface 28 being oriented upwards when in use, a middle portion of the side edges 36 are joined or formed with part of the side edges 36 of the frame 20 aperture 25 to enable the ends 35 to point downwards. Each end 35 has a hollow shaft 40 extending from one side edge 36 to the other. An axle (not shown)—having ends, is adapted to slidably inter-fit within the hollow shaft 40 to enable one wheel 13 to be affixed to each axle end. The axles are oriented substantially parallel to the end edges of the frame platform 20 and to each other or can be substantially at right angles to the track length.

Figure 5:
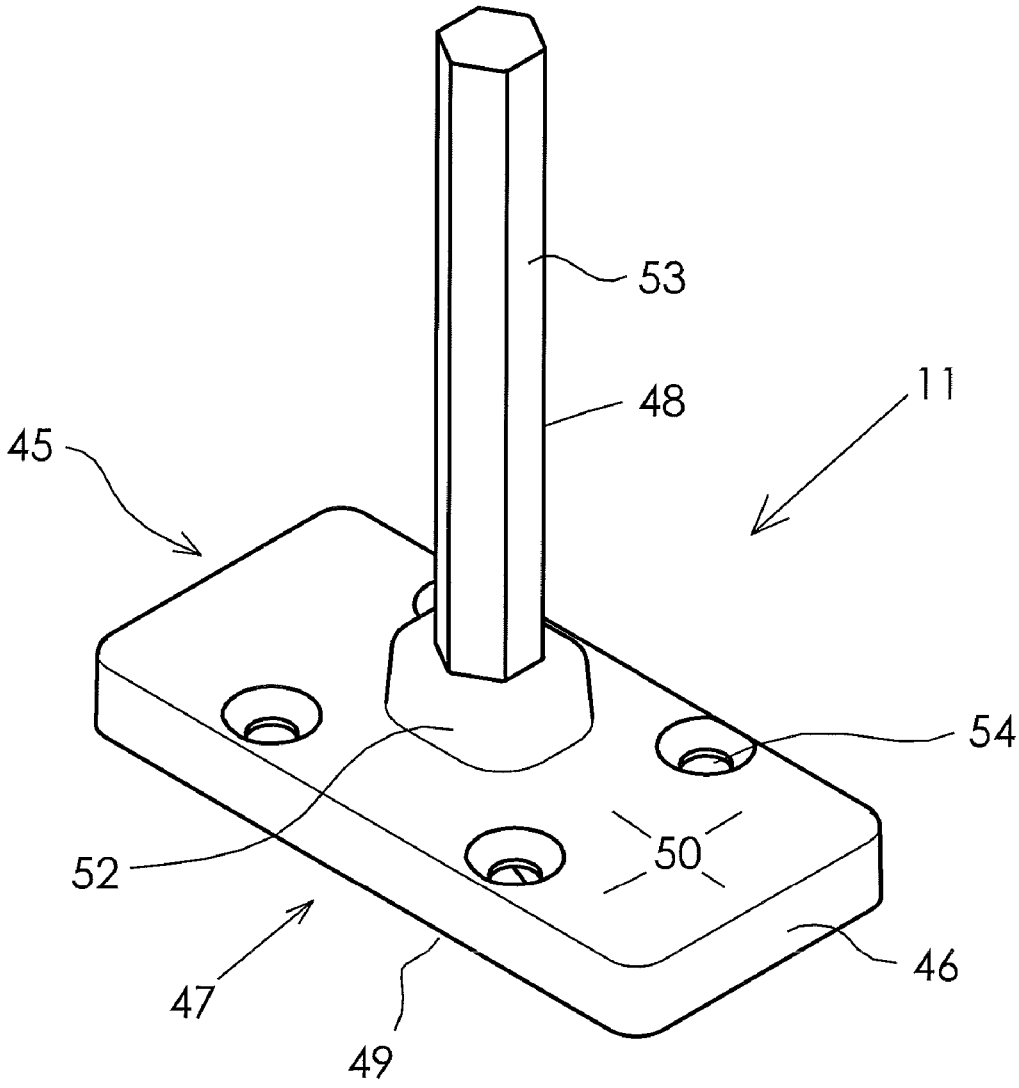
Figure 6:
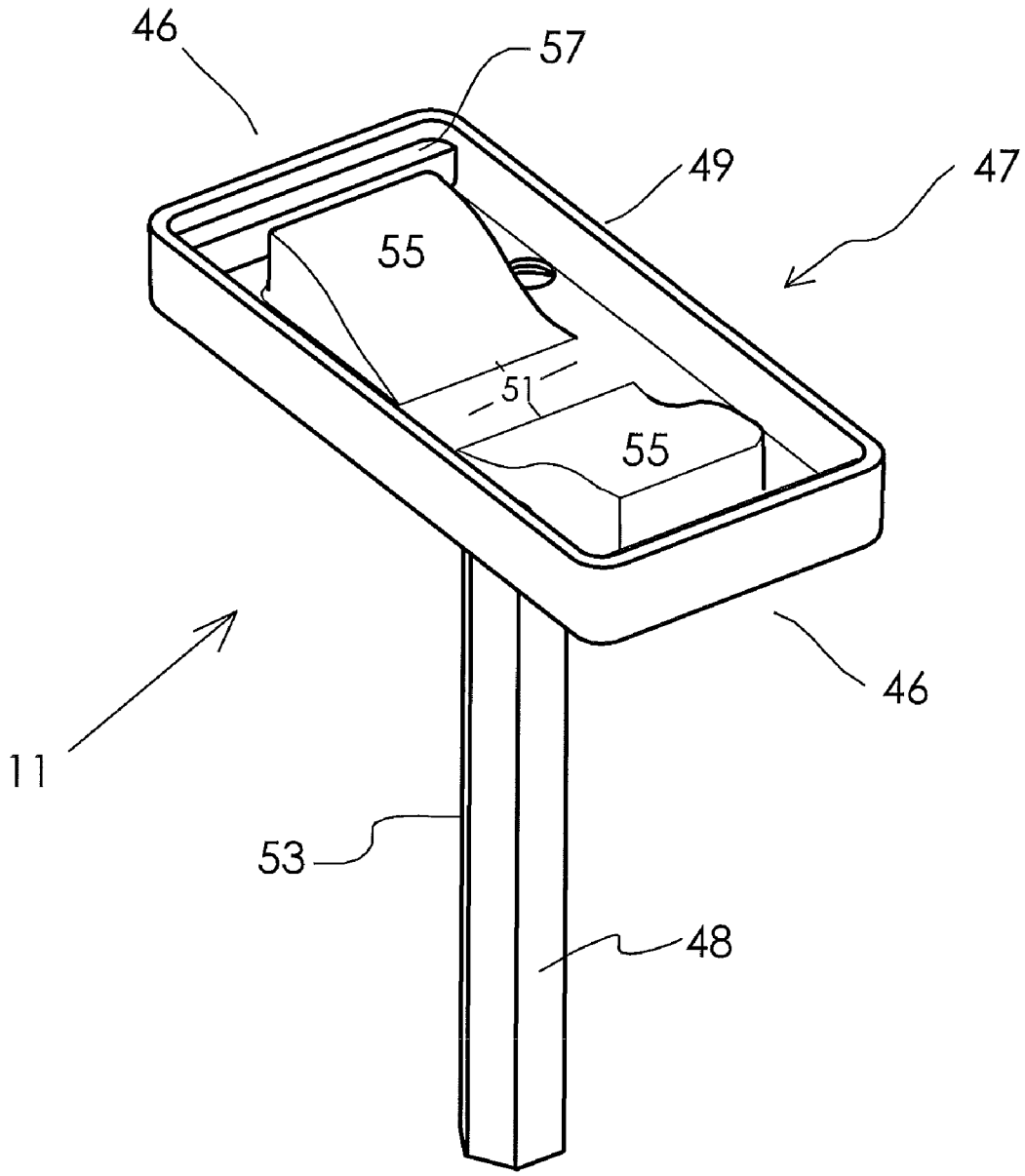
Figure 7:
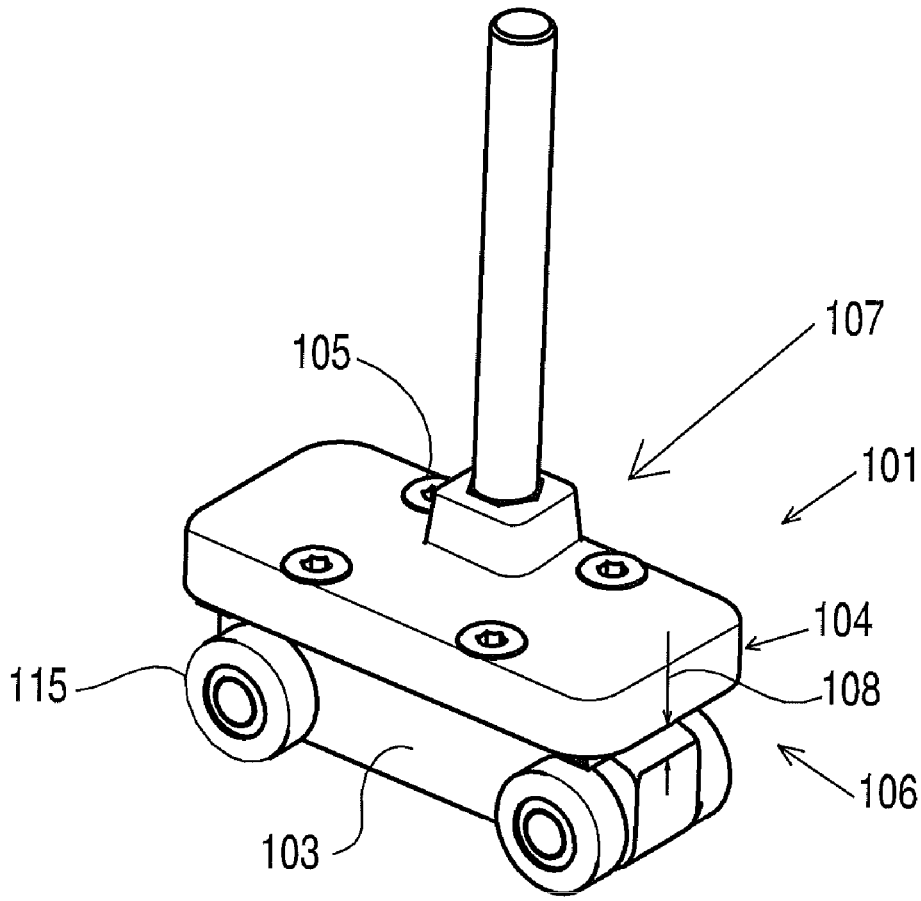

Upper carriage 11 as shown in FIGS. 5 and 6 comprises a plate member 45 being shaped and dimensioned with respect to the platform of the lower carriage 10—being the same overall area and having ends 46 and sides 47, and an up stand member 48 extending there from which is adapted to join with a hinge. Plate member 45 comprising an elongate planar portion 47 with a continuous perimeter downwardly extending lip member 49 there being ends and sides. Plate member 45 has an outer surface 50 and inner surface 51. Up stand member 48 extends from a plinth 52 which is attached to or formed on outer surface 50. Up stand member 48 is shown having hexagonal cross section and a thread 53 which is shaped to prevent rotation any attached door which up stand member 48 is adapted to allow a door support means thereon to in-turn support a bi-fold door (not shown).

Figure 3:
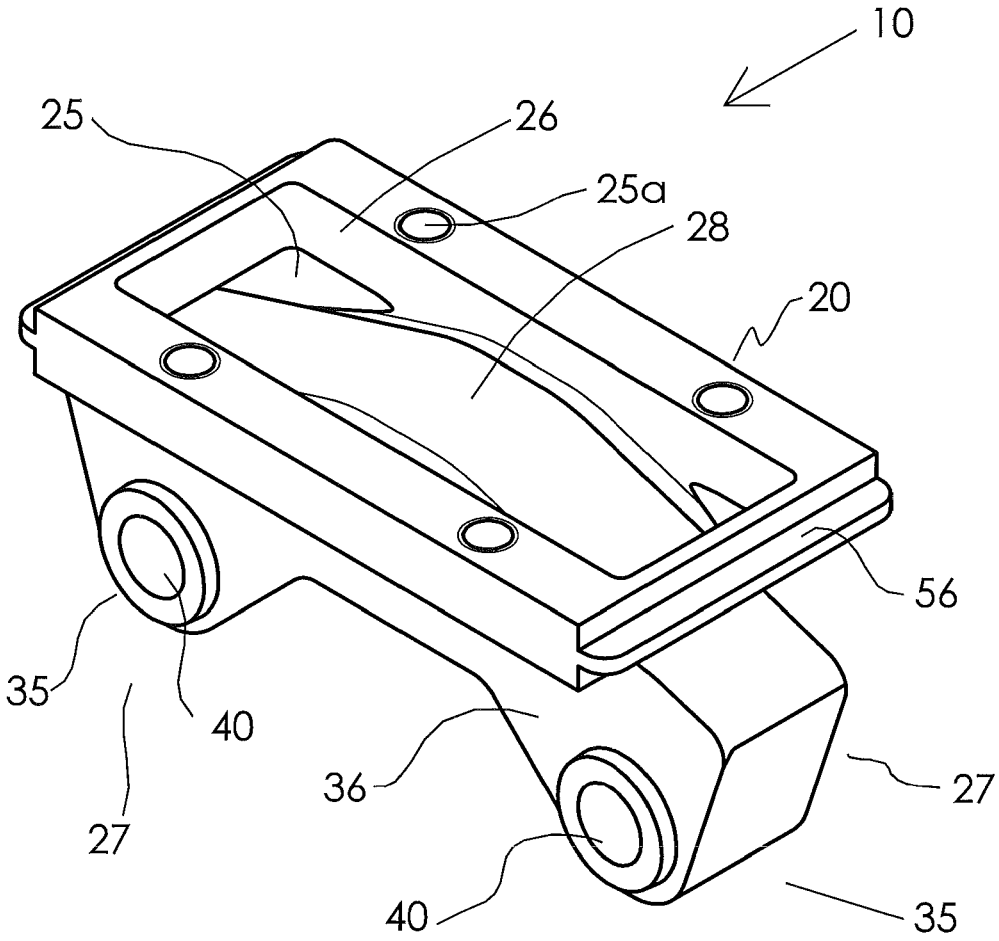
As shown in FIGS. 3 & 4 lower carriage 10 has an upper body portion in the form of a perimeter frame 20 with an aperture 25 therein and fixing apertures 25*a* located in the frame 20 therein. The frame 20 has an inner side edge 26 being perpendicular to an upper facing surface and lower facing surface.
Figure 4:
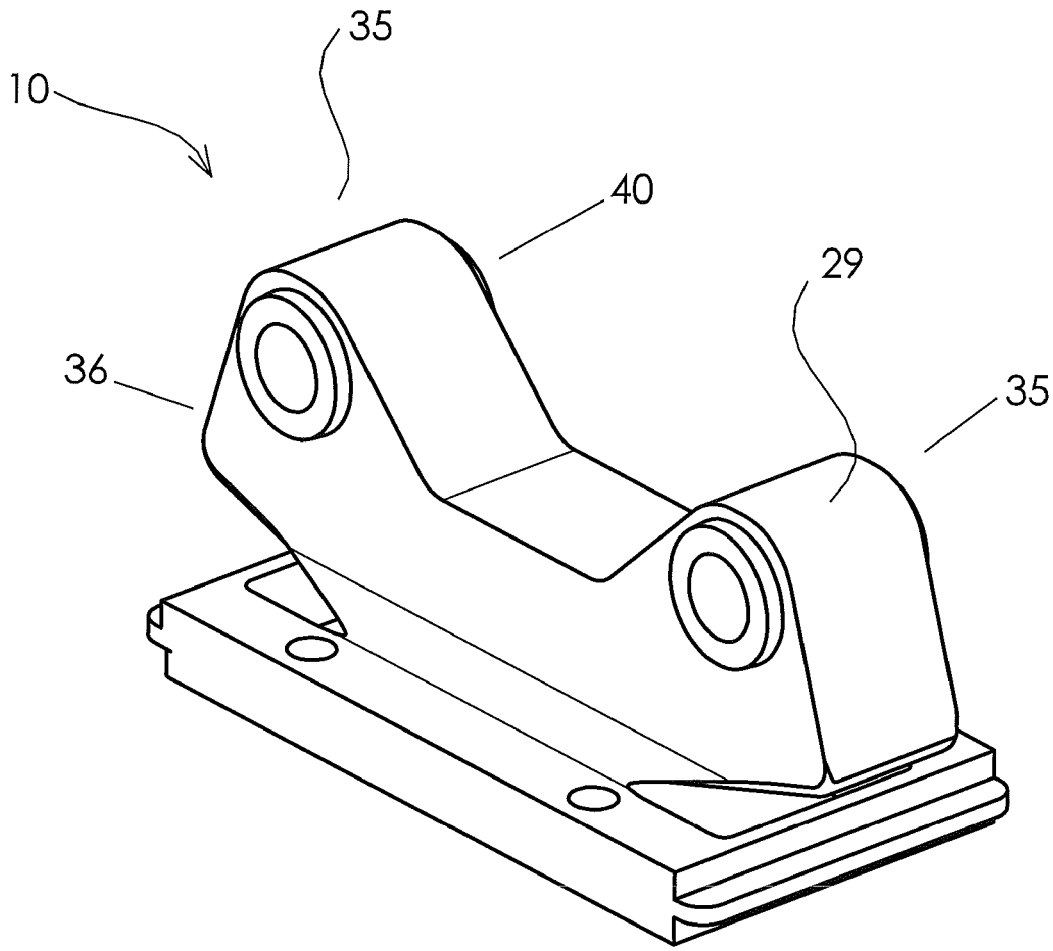

As shown in FIG. 5 the upper carriage 11 having outer surface 50 is also provided with apertures 54 for fixing which are shaped and aligned with the apertures 26 (see FIG. 3) in the platform 20. Underneath the plate member 45 there are deflecting portions 55 formed as spaced curved ramp portions (S shaped in cross section) as shown on FIG. 6 comprise ramp portions being spaced apart whereby the bottom of both ramps are spaced and adjacent to one another and the top of the ramps are located at the end of the plate 45 but being spaced somewhat from the end perimeter edge 46 and also spaced from the sides perimeter edges 47 to allow the apertures 54 to be clear. Ramps 55 have an outer surface shaped similarly to the outer surface 28 of the wheel holding portion 27 and together form a captured sliding surface means for the dust cover to be guided and move over and along.

The curvature of the ramps 55 and surface 28 can be smooth or the leading angle of the ramp can be at least 18 degrees but must be shallow enough to allow a flexible elongate dust cover 61 to gently move out of or dislodge from, the side grooves of the edges of the re-entrant member when the carriage 2 is moving along the track and to be able to move back into the grooves after the carriage has passed. The dust cover 61 is movably edge supported by the re-entrant portions of the track 3 and must be flexible enough to be moved in and out of edge alignment and yet be strong enough to allow a point load like for example a person to stand on the dust cover 61 and not deform or break or dislodge. The dust cover 61 or strip can have a bead or raised rounded side edges 61*a*, at each end in cross section i.e. the long sides which can be combined with an undercut to better enable the dust cover 61 to move in and out of alignment with re-entrant edge of the track 3.

In use upper carriage 11 is affixed to the lower carriage 10. All of the lower carriage portion 10 and wheels 13 are enclosed by space 17 of the track 3 and can not normally be seen. Upper carriage 11 is fixed by fixing means to the lower carriage 10 either before or after mounting of the wheels of the lower carriage portion 10 on the track surface 19. The end edges of the platform 20 have protruding tongue members 56 and plate member 45 of the upper carriage 11 has a ledge member 57 adapted to abut the tongue member 56 whereby the perimeter edges of the upper carriage 11 are adapted to envelop or capture and abut the edges of the lower carriage portion 10. Also when fitting together (FIGS. 1 and 2) the lower carriage 10 and upper carriage 11 using fixing means 59 through apertures 25*a* and 54, this means that the curved outer surface 28 (one part of the sliding surface means) of lower carriage 10 is close to, in a constant spaced dimension to form a gap 58 there between from the ramp surfaces 55 (other part of the sliding surface means) of the upper carriage 11.

Figure 1:
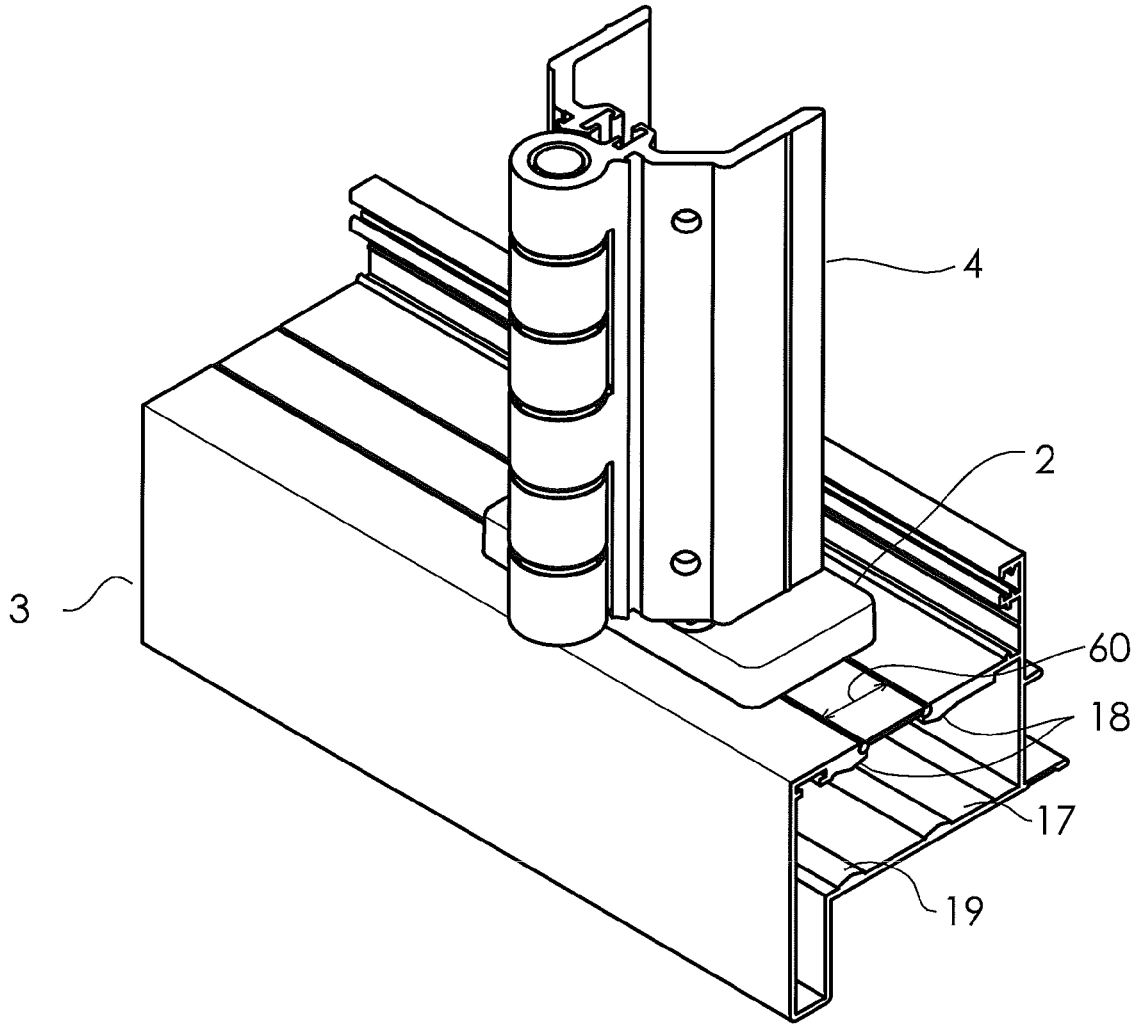
As shown in FIGS. 1 and 2 wheels 13 allow the carriage assembly 2 and door or window to move along the track 3. The wheels 13 are movably supported and guided by the track 3.
Figure 2:
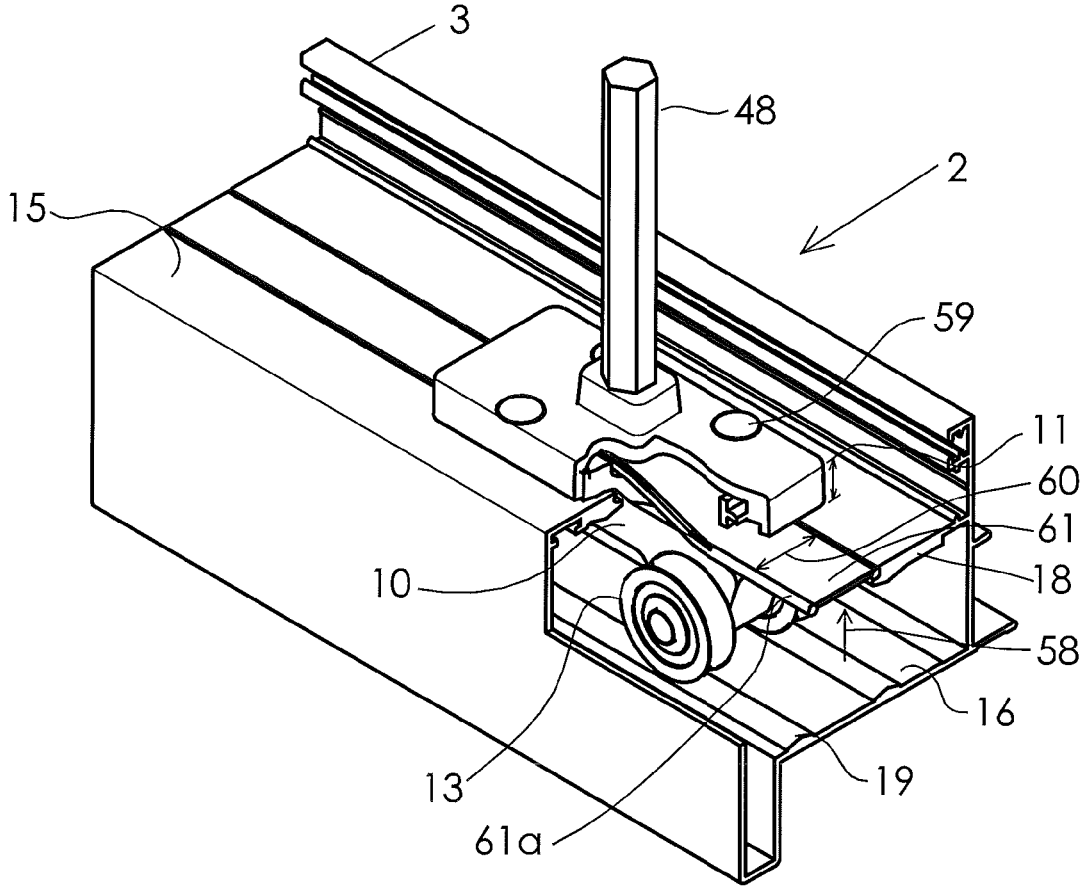

As shown in FIGS. 1 and 2 track 3 re-entrant channel shaped member having an opening 60 with the removable dust cover 61 which is formed of a material such that in use it can enter the gap between curved member 28 and the ramps 55 and be slidably captured by the assembled carriage 2 to allow the carriage 2 and bi-fold door (not shown) to be opened or closed whereby the carriage 2 moves over and under the dust cover 61 via the ramps 55 and curved surface 28 which slidably moves through the assembled carriage 2 while maintaining a covered or closed opening 60.

The dust cover 61 is elongate in shape having elongate side edge beads 61*a* which are shaped to slidably interfit and be supported with a matching elongate recess or groove on both edges of the opening or mouth 60 of the re-entrant portion of the track 2. The dust cover 61 can be flexible strip which fits into the grooves on either side of the mouth of the channel or track and are popped out of the channel by a pair of ramps which fit into the carriage body which moves along the track.

In another option the carriage assembly 2 can include a brush means which includes brush members attached to the carriage at either end to brush any dust or debris from the track or dust cover. The dust cover 61 can be plastics or it can be reinforced with a thin layer of stainless steel bonded to the plastics. For example only, the dust cover 61 thickness can be 1 mm to 2 mm thick plastics and 0.15-0.20 mm stainless steel which can be heat bonded to the plastics. Other dimensions for the cover and its components are equally possible. This can be done separately or by a co-extruding process together to bond them. A typical door might impose a downward load of say up to 200 kg down onto the carriage assembly 2.

A method of installing the carriage assembly includes:

providing a track with a dust cover;

cutting out a portion of the track and dropping in lower carriage;

installing other window framing components (e.g. jamb and head members) for opening;

attaching upper carriage to the lower carriage to slidably surround the dust cover;

attaching door or window support means to the upper carriage;

attaching door or window to the door or window support means such that the door and carriage can slide along the track and dust cover thereby maintaining a dust and or moisture cover at all times. Other options in the method are also possible.

FIGS. 7-13

As shown in FIGS. 7-13 there is a second embodiment of the assembly as shown in FIGS. 1-6 whereby the main change is that the upper sliding surface is now provided by the lower carriage.

A carriage assembly includes a carriage 101 for a track 102 (see FIGS. 9-13) wherein the carriage 101 comprises in use, a lower carriage 103 removably joined or fastened to an upper carriage 104, by fixing means 105. As shown the size and shape of a portion of the lower carriage 103 is shaped to be captured by the upper carriage 104 which is shown generally as being in the shape of a block having ends 106 and sides 107 so that a gap 108 is formed there between for a track/dust cover or flexible sealing member 125 to slide there between when the carriage 101 move there along. The gap 108 extends from one end of the carriage 101 to the other.

Figure 8:
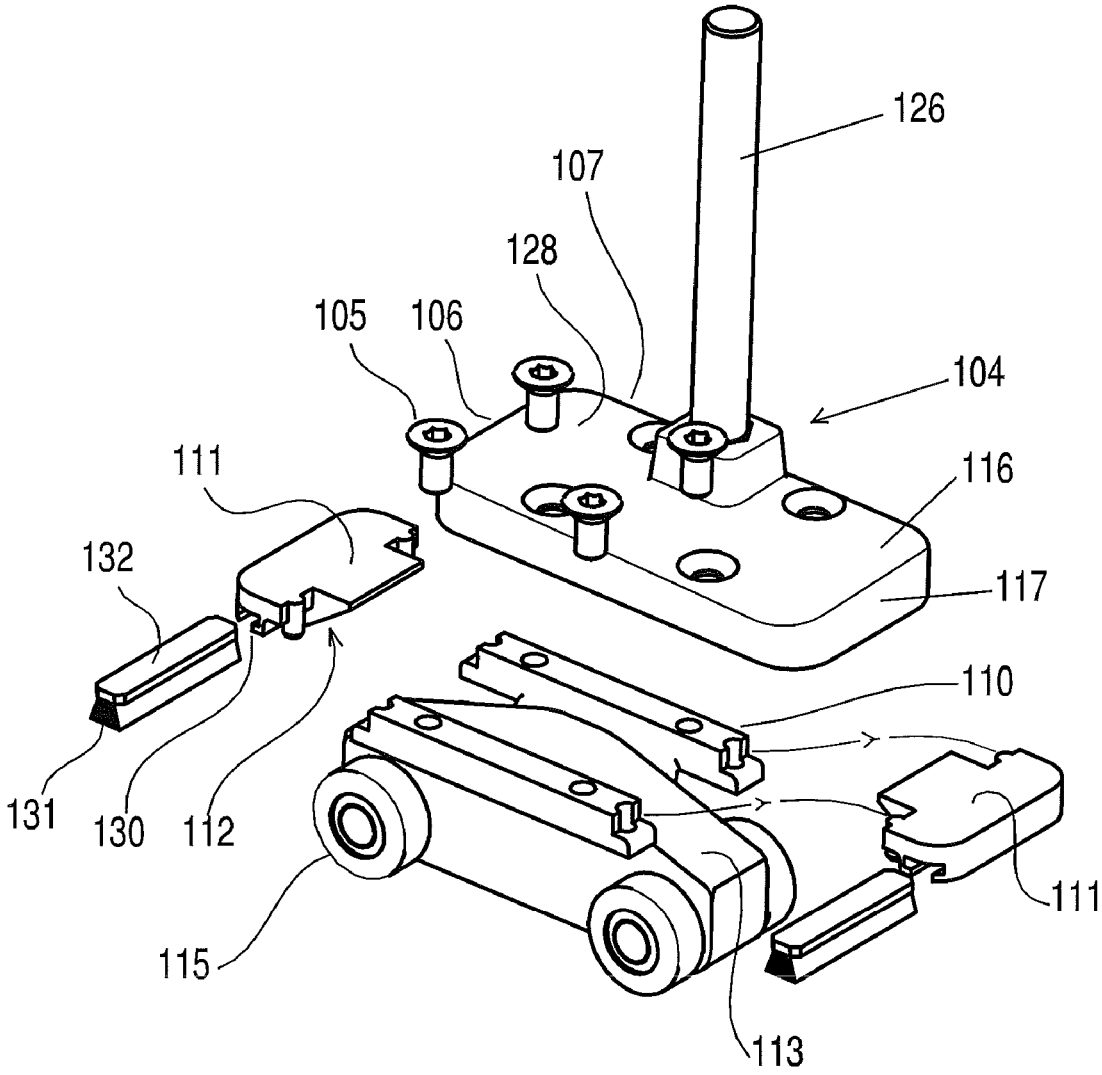

Lower carriage 103 as shown in FIG. 8 has a body including an upper body portion joined to a lower body portion. The upper body portion also has a frame 110 with upper ramp portions 111 at each end forming part of the gap 108 which includes a concave like spaced end ramp having a downwardly facing sliding surface means in the form of sliding surface 112. The lower body portion of the lower carriage 103 includes another portion of the gap 108 which includes a general convex shape whereby an in use upper portion is a lower ramp portions with upwardly facing sliding surface means in the form of sliding surface 113. At the lowest portion of the lower body portion of the lower carriage 103, there are rolling means in the form of wheels 115 there being a pair at each end mounted on respective axles.

With the upper body portion and lower body portion joined or formed as the lower carriage 103, the gap 108 formed between, is a substantially planar slit-like space there between surfaces 112 and 113 (which are sliding surface means) in an overall elongate convex shape (parallel with track length) with ends being lower than the centre portion of the convex shape.

Figure 9:
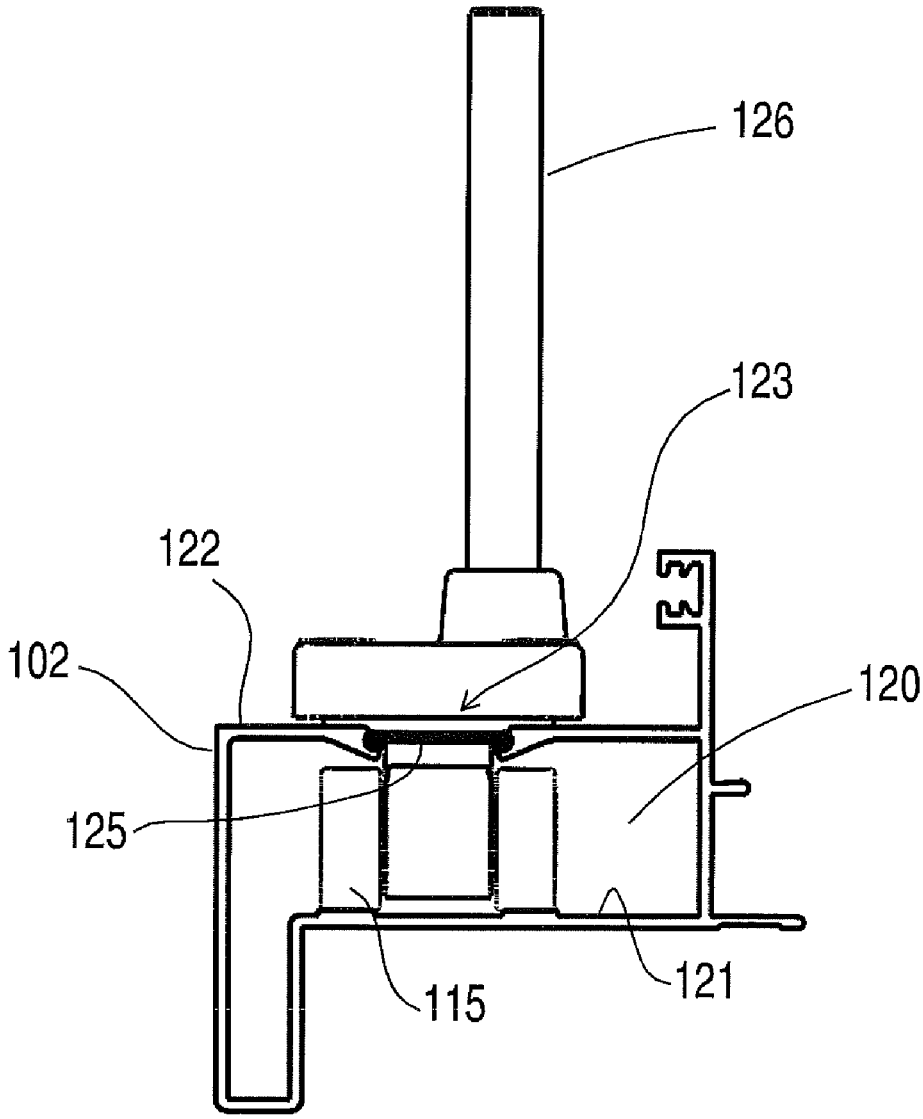
Figure 10:
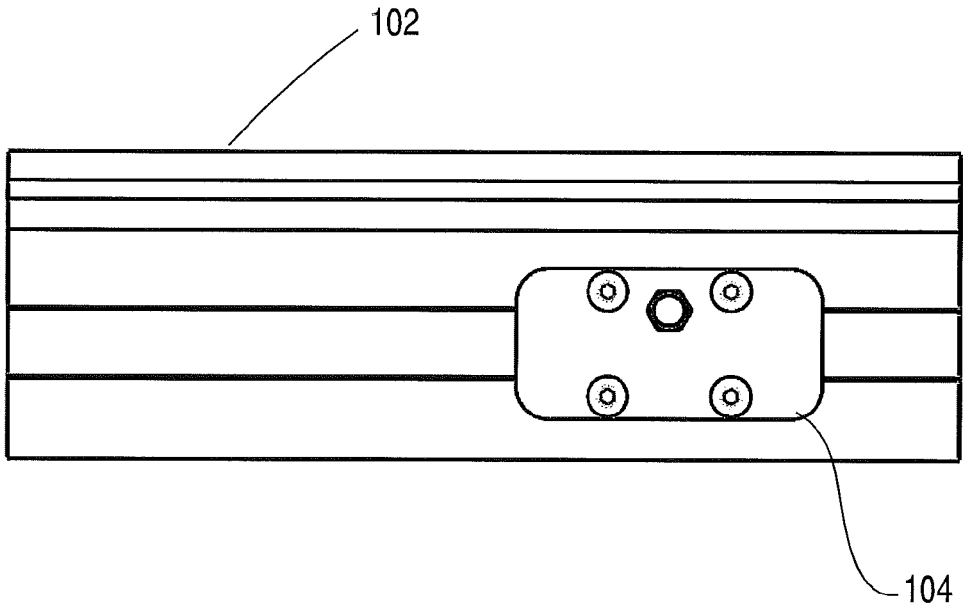
Figure 11:
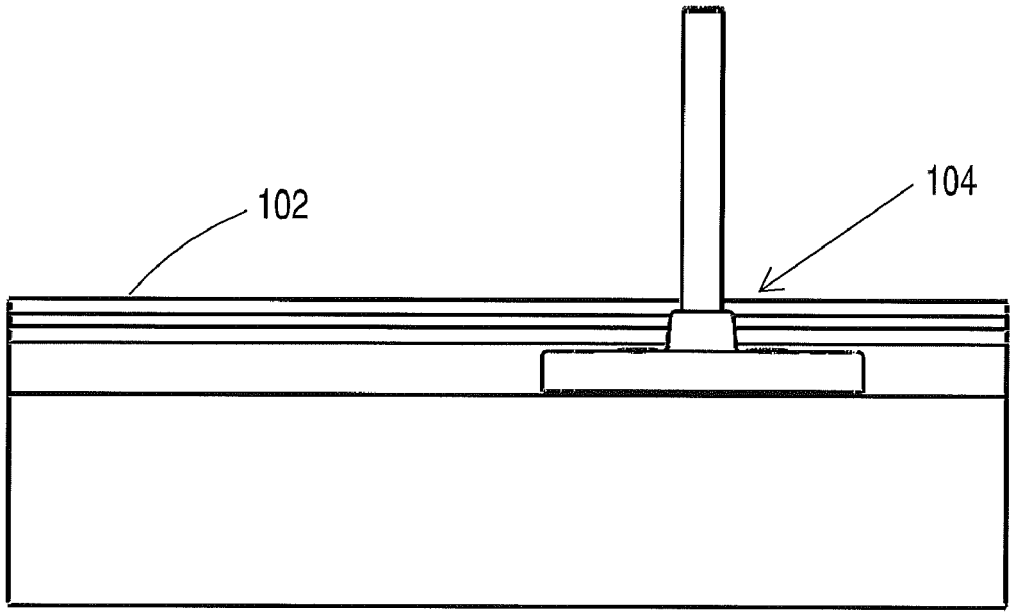

The upper carriage 104 comprises in use a plate 116 with downwardly extending rims 117 which in use when fastened, surround the upper body portion of the lower carriage 103 portion whereby only the upper carriage 104 is visible as shown in FIGS. 9-11. The whole of the lower carriage 103 is hidden by the track 102. The track 102 comprises a box cross section extrusion having a central confined space 120 (FIG. 9) with a lower inner surface 121 for the wheels 115 to roll on, an outwardly facing surface 122 and a re-entrant top portion 123 removably covered by the track 102 which is in the form of a flexible sealing member. The re-entrant top portion of track 102 has edge members ending in a groove sized and adapted to hold and support the side edges of the track 102 along the entire length of the track so that both dust and/or moisture is prevented from entering and also provides support for walking on.

Upper carriage 104 also includes a door hinge support means 126 which can be in the form of an upstanding post that is mounted to an or from an outside upper surface 128 of the upper carriage 104

Figure 12:
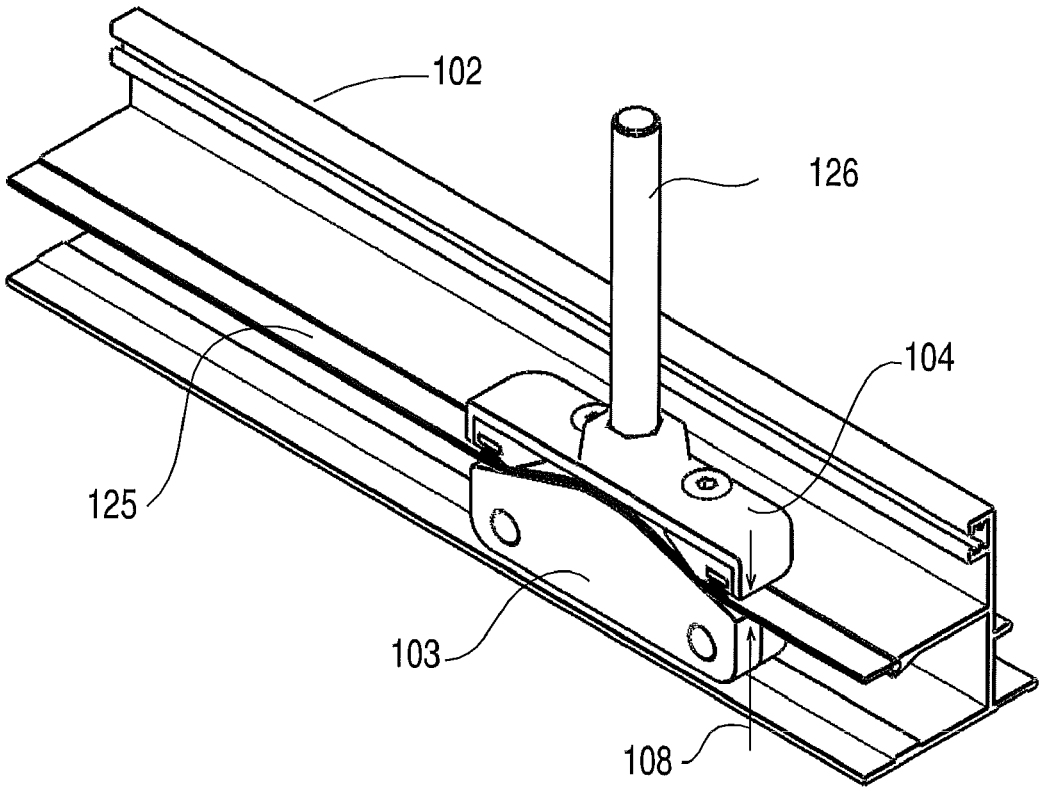
Figure 13:
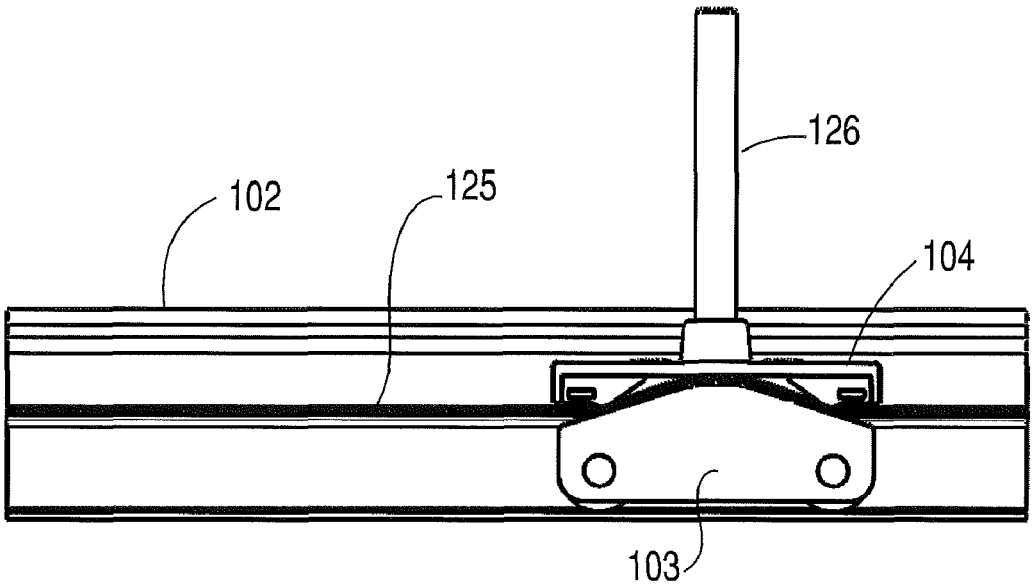

The flexible sealing member or track cover 125 as shown in FIGS. 9, 12 and 13 is designed to be fed through the slit space or gap 108 when the wheels 115 are rolled or moved along the track inner surface 121.

Upper body portion of the lower carriage 103 also can include end brushing means which include a downwardly slotted transversely oriented slot 130 for cleaning means in the form of a removable brush 131 removably attached to a support part 132 so that the support part 132 is slidably fitted into the slot 130 to allow the brush 131 to be exposed & extend in use to brush both from both ends of the carriage assembly, the upper surface 122 of the track 102. This brush 131 can also be added to the first embodiment of FIGS. 1-6 as well as for FIGS. 7-13. The cleaning means in the form of a brush member can be attached to the carriage 101 to wipe excess debris from the cover prior to the disengage/re-engaging action of the cover.

The carriage assembly and track 102 can be constructed to form a sealed chamber to prevent dust or any contamination therein.

Advantages a) Pleasing appearance.

b) Easy to keep clean c) Straight forward installation d) Little or no dirt or debris to jam the track.

e) Modest manufacturing cost f) Long life g) Able to be used for sliding and bi-fold doors h) Robust construction i) Able to keep dust and or moisture out of the track during movement of the carriage.

j) Dust cover is strong enough to be walked on.

Variations

Throughout the description of this specification, the word "comprise" and variations of that word such as "comprising" and "comprises", are not intended to exclude other additives, components, integers or steps.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However it is to be understood that the invention may assume various alternative variations, except where expressly specified to the contrary. It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

All the members of the apparatus can be fabricated from solid or hollow shaped members. Also the components can also be formed as separate items and joined or formed as a one piece item. Typically the track can be aluminium and the dust cover 61 or 125 can be formed of a plastics material though other materials and combinations are equally possible. The wheel holding portion 27 can also be produced with the wheels and axles already in place. The method of installation can be varied whereby the carriage 2 can be preassembled i.e. with the upper and lower carriage portions 11 & 10 before being dropped into a door track 3.

The gap 58 or 108 as in both embodiments is shown as being curved in the shape of an upwardly shaped curve though other curve shapes are equally possible. The track can be simply a member which the carriage rolls or moves along but the track can be part of the door or window frame as required. Though a frame or a solid plate like member is shown other variations on these shapes can also be used without affecting their function.

The dust cover 61 or track cover 125 as mentioned throughout the specification an also be fabricated as one piece or more than one piece with similar or a combination of different materials such as for example plastics and stainless steel with the stainless steel being a top layer, and plastics for a lower layer and sliding thereon. Also not all of the dust cover or curved surfaces may be used to slide there against at least a portion of these surfaces may be used. There are other methods of attaching the dust cover to the track which can include hook and loop or clip in place for example, as long at the cover can be fed through the carriage assembly in an, in-out-in type manoeuvre.

For the installation the method can be varied whereby for example the carriage can be assembled before installing the track. The door or window support means can also be installed say when assembly the carriage rather than later. The rest of the window or door frame can be installed when installing the bottom frame. Though doors and or windows are shown any other structures can also be movably supported by the carriage.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

It will also be understood that where a product, method or process as herein described or claimed and that is sold incomplete, as individual components, or as a "kit of Parts", that such exploitation will fall within the ambit of the invention.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

It will also be understood that where a product, method or process as herein described or claimed and that is sold incomplete, as individual components, or as a "kit of Parts", that such exploitation will fall within the ambit of the invention.

What we claim is:

1. A movable carriage assembly for a door or window comprising a track having a dust cover engaged on said track whereby the movable carriage assembly is adapted to movably support the door or window, the carriage assembly includes a lower carriage removably joined to an upper carriage, forming an elongate gap therein providing a sliding surface for said dust cover to slide therein when the carriage assembly moves along the track, the dust cover moves through the gap of the carriage assembly and over the sliding surface whereby the dust cover disengages from the track and reengages with the track after the carriage assembly has passed.

2. A movable carriage assembly for a door or window as claimed in claim 1 wherein the elongate gap is formed in use having an upper sliding surface and a lower sliding surface wherein the elongate gap is curved in shape extending from a first end of the carriage assembly to a second end of the carriage assembly.

3. A movable carriage assembly for a door or window as claimed in claim 2 wherein, the lower carriage comprises a body with an upper body portion and a lower body portion, the upper body portion includes a frame and the lower body portion includes a convex shaped body whereby the frame is supported by the convex shaped body, and the convex shaped body includes wheels to rollably move on the track and also includes the lower sliding surface for the dust cover to slide there against.

4. A movable carriage assembly for a door or window as claimed in claim 3 wherein, the upper carriage includes a plate shaped member with an upstand member extending there from, the upstand member is adapted to support a door or window there from and the dust cover is an elongate flexible strip member.

5. A movable carriage assembly for a door or window as claimed in claim 4 wherein the track is an elongate member formed having a box shaped cross section with an inner lower track surface and a re-entrant upper portion with grooved edges adapted to allow the flexible dust cover to be fitted and supported therein and there along.

6. A movable carriage assembly for a door or window as claimed in claim 5 wherein a substantial portion of the upper sliding surface is provided by the lower carriage whereby the frame includes end ramp surfaces spaced apart being downwardly facing.

7. A movable carriage assembly for a door or window as claimed in claim 5 wherein the upper sliding surface is provided by the upper carriage whereby the plate member has a ramp surface spaced underneath at each end to allow the dust cover to slide there against.

8. A movable carriage assembly for a door or window as claimed in claim 7 wherein, when in use the carriage assembly moves along the track, the ramps and curvature of the elongate gap must be shallow enough to allow the dust cover to gently move out of and into the groove edges of the re-entrant member of the track.

9. A movable carriage assembly for a door or window as claimed in claim 8 wherein, the dust cover must be flexible enough to be moved out of edge alignment and yet be strong enough to allow someone to stand on it and not deform or break or dislodge from the track wherein the dust cover is provided an undercut to better enable the dust cover to move into and out of alignment with the grooved edges of the track.

10. A movable carriage assembly for a door or window as claimed in claim 9 wherein, the track and carriage assembly form a sealed chamber to prevent dust or any contamination therein.

11. A movable carriage assembly for a door or window as claimed in claim 10 wherein, the carriage assembly includes a cleaning means in the form of a brush member attached to the carriage to wipe excess debris from the dust cover prior to the dust cover disengaging from the track.

* * * * *